US005190634A

United States Patent [19]

Fernandez-Baujin et al.

[11] Patent Number: 5,190,634

[45] Date of Patent: Mar. 2, 1993

[54] INHIBITION OF COKE FORMATION DURING VAPORIZATION OF HEAVY HYDROCARBONS

[75] Inventors: Jorge M. Fernandez-Baujin, North Bergen; Kandasmy M. Sundaram, West Paterson; Jo-Lung Chien, Cedar Grove, all of N.J.

[73] Assignee: Lummus Crest Inc., Bloomfield, N.J.

[21] Appl. No.: 278,999

[22] Filed: Dec. 2, 1988

[51] Int. Cl.[5] ..... C10G 47/22; C07C 4/04

[52] U.S. Cl. ..... 208/107; 208/130; 208/132; 585/648

[58] Field of Search ..... 208/107, 130, 132; 585/648, 649, 650

[56] References Cited

U.S. PATENT DOCUMENTS

| | | | |
|---|---|---|---|
| 3,365,387 | 1/1968 | Cahn et al. | 208/132 |
| 3,579,438 | 5/1971 | Cruse | 208/132 |
| 4,298,457 | 11/1981 | Oblad et al. | 208/107 |
| 4,361,478 | 11/1982 | Gengler et al. | 208/130 |
| 4,479,869 | 10/1984 | Petterson | 208/130 |
| 4,587,011 | 5/1986 | Okamoto | 208/129 |
| 4,599,478 | 7/1986 | Kamisaka | 585/648 |
| 4,615,795 | 10/1986 | Woebcke et al. | 585/648 |
| 4,617,109 | 10/1986 | Wells et al. | 208/132 |

*Primary Examiner*—Anthony McFarlane

*Attorney, Agent, or Firm*—Richard H. Berneike

[57] ABSTRACT

An improved process for vaporizing a crude petroleum feedstock, preferably one boiling in the vacuum gas oil range or higher, prior to thermal cracking to olefins, wherein such feedstock is preheated, in one or more stages, in the convection section of a tubular steam cracking furnace, characterized by conducting the preheating in the presence of a small amount of hydrogen, preferably at a hydrogen/feed ratio of from about 0.01 to about 0.15 wt. %, so as to inhibit coke formation.

3 Claims, 4 Drawing Sheets

INHIBITION OF COKE FORMATION DURING VAPORIZATION OF HEAVY HYDROCARBONS

BACKGROUND OF THE INVENTION

1. Field of the Invention

This invention relates generally to a process for vaporizing a crude petroleum feedstock prior to the thermal or steam cracking of such feedstock to olefins and other petrochemicals. More particularly, it relates to the preheating of such a feedstock, preferably one boiling in the range of a vacuum gas oil or higher, in one or more stages, in the convection section of a conventional, tubular (steam) cracking or pyrolysis furnace.

2. Description of the Prior Art

Production of olefins in general and of ethylene in particular has been achieved in the past by thermal cracking of a crude petroleum hydrocarbon feedstock and rapidly quenching the cracked effluent, e.g. in a transfer line (heat) exchanger. During the last two decades or so, the trend has been to use heavier and heavier feedstocks than the ethane or naphtha feedstocks once used predominantly. However, the use of such heavy feedstocks, e.g. vacuum gas oils and those boiling higher, i.e. a heavy residuum fraction having an initial boiling point above 230° C., has led a variety of operating problems, the foremost one of which has been coke formation. It has been necessary to preheat the heavy oil or any liquid hydrocarbon feedstock to a reaction inlet temperature of about 600° C. Conventionally, the preheating of the heavy hydrocarbon feedstock is achieved by heating it in the convection section of the ordinary tubular pyrolysis or thermal cracking furnace to a temperature of about 200° C. to about 260° C., or, alternatively, by heating such a feedstock in indirect heat exchange relationship to about 225° C. to about 260° C. The heated liquid is then mixed with superheated steam and externally flashed, i.e. outside the convection section, to 600° C. from the vaporization mix temperature of 380° C., or it is separated from the vapor phase and vaporized externally in a flash drum by being contacted with superheated steam or a preheated mixture of steam and vapor phase feed. These methods of external flash vaporization have been done to avoid convection section coking, and have been well documented in U.S. Pat. No. 3,617,493; 3,718,709; and 4,264,432.

U.S. Pat. 4,264,432 specifically recites the features of external mixing of the preheated hydrocarbon feedstock with superheated steam followed by flashing.

U.S. Pat. No. 3,617,493 discloses the use of an external vaporization drum for the crude oil feedstock and recites the use of a first flash wherein the overhead vapor is naphtha and of a second flash in which the overhead vapor is a gas oil boiling between 230° C. and 600° C. Residual liquids are removed, stripped with steam, and used as fuel.

U.S. Pat. No. 3,718,709 discloses a pyrolysis process that is designed to minimize the coke deposition in the radiant coils. It specifically discusses the preheating of heavy oils to an extent of vaporization of about 50% with superheated steam and the separation of the residual liquid at temperatures approximating 300° C.–450° C. In column 3, lines 6–9 of this patent, it is expressly stated that:

"The composition of the feed (steam: hydrocarbon) is to be maintained within the limits (of 0.5–5.0) in order to avoid deposits of coke in the furnace tubes."

The solutions to the problem of coking formation and deposition through the measure of external flash vaporization, such as that proposed by the above three U.S. patents, are, however, quite costly in that they require increased costs of equipment and piping, owing to the fact that they have to be constructed of expensive alloys. Moreover, owing to the difficulties in controlling the flows of the hot vapor and liquid streams, an individual mixer flash drum system might have to be provided for each radiant heating coil used in the pyrolysis furnace. For a furnace with multiple radiant coils, this would substantially increase the investment cost of each furnace.

The present invention, however, offers an economically advantageous alternative to the external flash vaporization systems and methods to avoid convection section coking. It does not require increased equipment and piping costs, nor does it suffer from the dead space inherent in a flash drum design which promotes more than the usual amount of coke formation which, once formed, is a tarry material that is very difficult to remove from the drum and to discard.

The advantages of this invention are achieved through the use of a small, critical amount of hydrogen in the convection section to inhibit the polymerization reaction of the hydrocarbons preheated therein, thereby inhibiting coke formation in the convection section tubes resulting from such polymerization reaction. Such coke formation not only limits heat transfer in the convection section, it also increases the pressure drop throughout the whole system. The increased pressure drop causes premature shut-down of the furnace and, concomitant therewith, decreased production, thereby decreasing the profitability of the furnace operation.

Use of a small, critical amount of hydrogen in the convection section during the preheating of the crude (heavy) petroleum feedstock is not to be confused with hydrogenation, hydrocracking, or other downstream reactions in which extensive amounts of hydrogen are present, with or without a catalyst also present, to promote pyrolytic cracking of the feedstock to lower molecular weight hydrocarbons and/or to eliminate sulfur, nitrogen, asphaltenes, and metals such as Ni, V, Na, Fe, and Cu that may be present in the charge, and/or to hydrogenate the aromatic constituents present in the charge.

Thus, for example, U.S. Pat. No. 3,842,138; 3,898,299; 3,907,920; 3,919,074; and 4,285,804 all disclose the use of large excesses of hydrogen for the above purposes.

U.S. Pat. No. 3,842,138 discloses a method of thermal cracking of hydrocarbons under pressure and in the presence of an excess of hydrogen. The excess hydrogen is defined as a molar concentration of hydrogen in the effluents of at least 20% at a pressure between 5–70 bars, a temperature above 625° C., and a residence time of less than 0.5 second.

U.S. Pat. No. 3,898,299 describes a two-stage process for the production of olefins wherein residual oil feedstocks are catalytically hydrogenated prior to thermal cracking of a distillate fraction of the liquid phase separated from the hydrogenated product. Excess hydrogen, described as about 5 to 10 times the molar rate of the residual feedstock fed to the hydrogenation zone, is disclosed.

U.S. Pat. No. 3,907,920 discloses another two-stage process for producing ethylene comprising an integrated hydro-pyrolysis-cracking process wherein the preferable hydrogen/hydrocarbon oil mole ratio for the so-called hydropyrolysis is in the range of about 3/1 to 30/1.

U.S Pat. No. 3,919,074 discusses the conversion of hydrocarbonaceous black oils into distillate hydrocarbons wherein hydrogen is admixed with the black oil charge stock by compressive means in an amount generally less than about 20,000 SCFB, preferably in an amount of from about 1,000 to about 10,000 SCFB.

U.S. Pat. No. 4,285,804 discloses a catalytic hydrotreatment of hydrocarbon oils boiling above 350° C. which is conducted under a partial hydrogen pressure usually in the range of from 50–200 bars, preferably from 90–150 bars; a temperature between 350° C.–470° C., preferably between 380° C.–430° C.; and a residence time for the liquid charge within the reactor of between 0.1–4 hours, preferably between 0.5–2 hours.

All of these last-enumerated U.S. Pat. No. 3,842,138; 3,898,299; 3,907,920; 3,919,074; and 4,285,804 therefore have to deal with excessive amounts of circulating hydrogen that have a heavy impact on the utilities consumption and investment costs of the olefin plant in which they are used. For example, high hydrogen amounts involve the circulation of large volumes of a hydrogen-containing stream for which compression thereof between 20–40 bars is necessary for its fractionation, thus involving prohibitive costs. In contrast, the small amount of hydrogen required in the case of the present invention only has a very small impact on utilities consumption and investment costs because the hydrogen is not needed to reduce the vaporization temperature of the charge but only to inhibit the polymerization of the small amount of olefins created in the convection section and thus reduce the coke precursor. Furthermore, little or no modification of the convection section is required in order to make use of the present invention, and such invention also makes it possible to eliminate the flash drum. Furthermore, use of the present invention can decrease the fouling rate in the transfer line exchanger employed to quench the cracked effluent of the furnace, owing to the presence of a higher concentration of hydrogen in the furnace effluent. However, the degree of improvement is dependent upon the amount of hydrogen added.

SUMMARY OF THE INVENTION

The present invention provides an efficacious process for inhibiting coke formation during the vaporization of heavy hydrocarbons by preheating such hydrocarbons in the presence of a small, critical amount of hydrogen in the convection section of a conventional tubular furnace. The critical hydrogen level, as practiced in this invention, is definable in terms of the hydrogen/hydrocarbon charge or feed ratio, and approximates about 0.01–0.15 wt. %.

Coke formation in the convection section normally occurs when the liquid portion of the hydrocarbon feedstock vaporizing in the heating coil of such section is exposed to excessively high tube wall temperatures. When such feedstock has physical characteristics similar to those of petroleum fractions boiling in the vacuum gas oil region or above, the problems of coke deposition during the vaporization of the feedstock are exacerbated because, at high temperatures, the polymerization reactions which normally take place in the liquid phase on metal surfaces are promoted. As a result, some reactant and product molecules polymerize to form heavier molecules which are tarry materials that become deposited on the walls of the convection section coil and eventually become coke. The present invention, as noted, prevents this problem by utilizing a critical amount of hydrogen to inhibit the polymerization reaction of the hydrocarbon charge during its preheating in the convection section of a conventional tubular furnace.

BRIEF DESCRIPTION OF THE DRAWINGS

The above and other features and advantages of the present invention will become more readily apparent from the following description with reference to FIGS. 1–3 of the accompanying drawings.

DESCRIPTION OF THE PREFERRED EMBODIMENT

Figure 1:
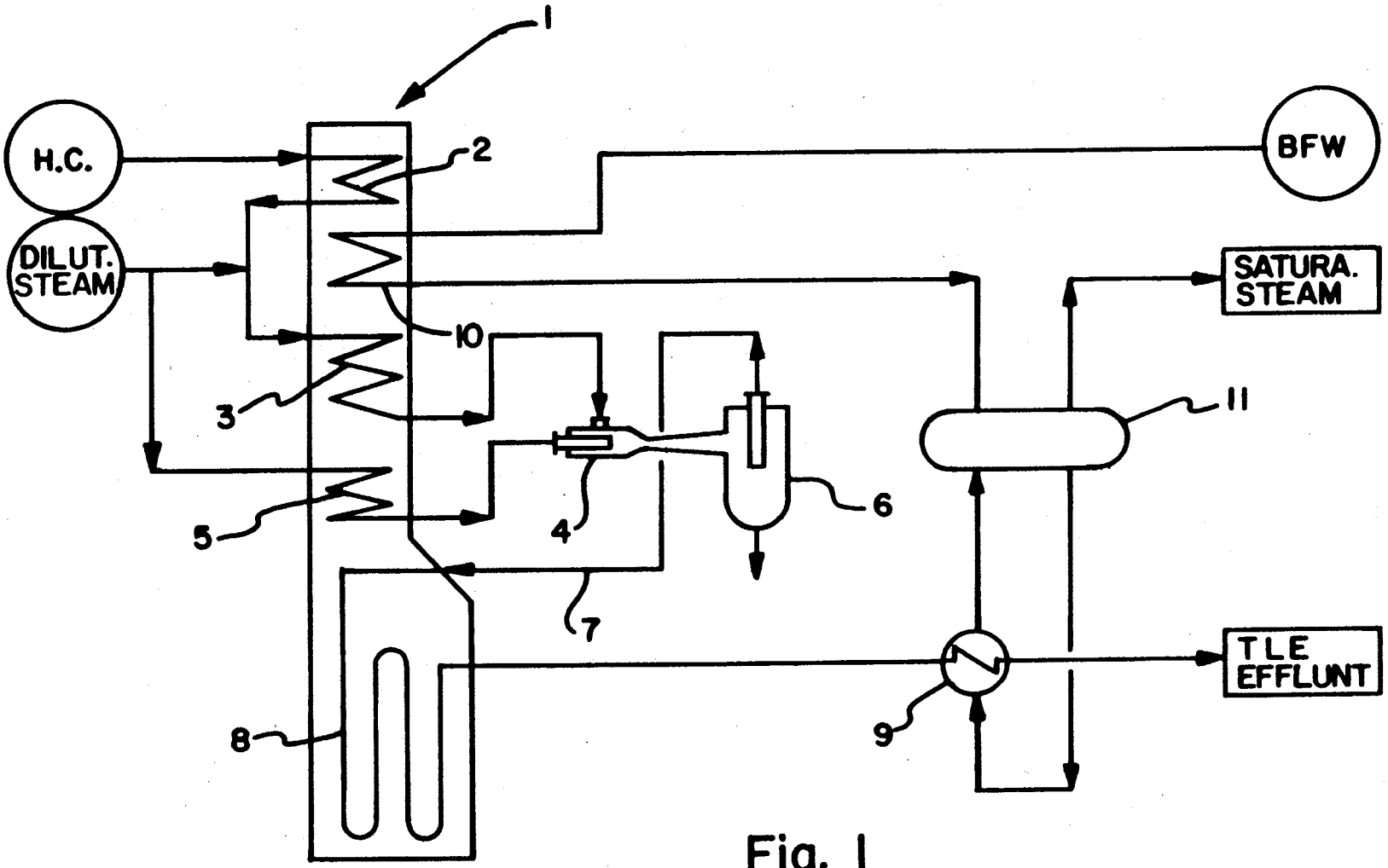
FIG. 1 depicts a flow diagram of a conventional single-stage external vaporization system and process for heavy hydrocarbon feedstock pyrolysis.

With reference to FIG. 1, a heavy crude petroleum feedstock is passed into the convection section of a conventional tubular furnace, indicated generally as 1, where it is preheated in the convection heating coil 2. The feedstock, after preheating, is then mixed with a small amount of dilution steam (a primary steam addition), and the mixed feed is then further preheated in another convection heating coil 3 to a temperature of about 400° C.–500° C. The resultant heated mixed feed then exits from the convection section and is passed into a mixer 4. The remainder of the dilution steam (a secondary steam addition) is superheated to about 650° C.–800° C. in another convection heating coil 5 of the convection section and passed to the mixer 4 for mixing with the partially vaporized feedstock preheated by heating coil 3. The mixer 4 is provided to ensure intimate contact between the highly superheated steam and the partially vaporized feed. The temperature of the steam is such that the final vaporization of the liquid feed takes place outside of the convection section, i.e. external vaporization, and in the mixer 4 and in the flash drum 6 (into which the mixture from the mixer 4 is passed and in which coke particles or tarry materials are separated from the vapor).

The vapor from flash drum 6, which is at a temperature of about 450° C.–700° C., is passed in line 7 into the radiant section of the furnace where it enters the radiant coil 8 for subsequent pyrolysis. The effluent from the radiant coil 8 is then passed into a transfer line exchanger 9 for cooling therein.

The boiler feed water coil 10 and the steam drum 11 are shown in FIG. I for purposes of showing waste heat recovery and usage, but no further discussion of their functions is necessary here in order to understand the operation of the present invention. FIG. 1, as thus depicted and described, accordingly represents the current state of the art for attending to the problems of avoiding coke formation in the convection section.

Figure 2:
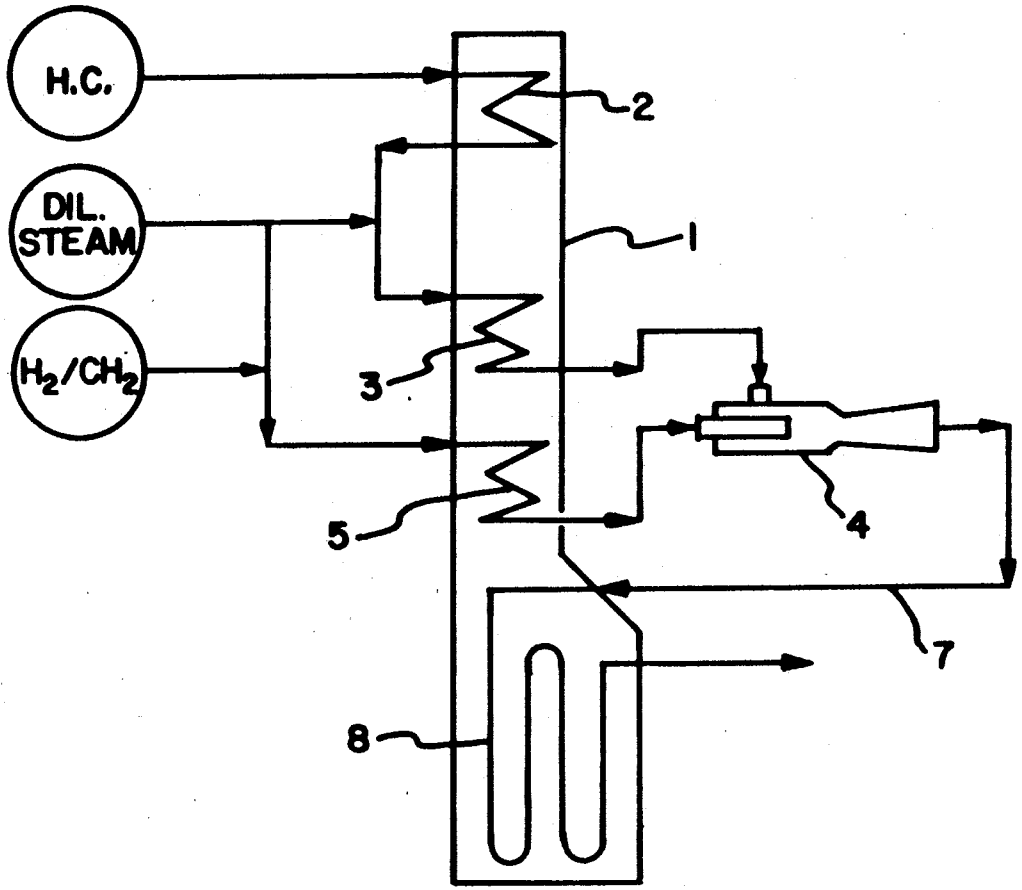
FIG. 2 depicts a flow diagram of one aspect of the present invention, and represents an alternative system and process to what is shown in FIG. 1. It illustrates a scheme in which the critical amount of hydrogen is added only to the secondary stream to inhibit coke in the mixer and downstream of the mixer.

FIG. 2 depicts, as noted, one aspect of the present invention, showing the use of a small, critical amount of hydrogen to inhibit coke formation in the convection section. In this FIG. 2, a conventional source of hydrogen such as a hydrogen/methane stream is shown being added to the secondary steam addition to inhibit coke formation in the mixer 4 and downstream of the mixer. Thus, the scheme illustrated in FIG. 2 shows the elimination of the flash drum 6, which would otherwise cause coke formation and removal problems. The transfer line exchanger 9, the boiler feed water coil 10, and the steam drum 11, although includable in this system because they are common to all hydrocarbon vaporization schemes, are not shown since they are not part of the essence of this invention.

Figure 3:
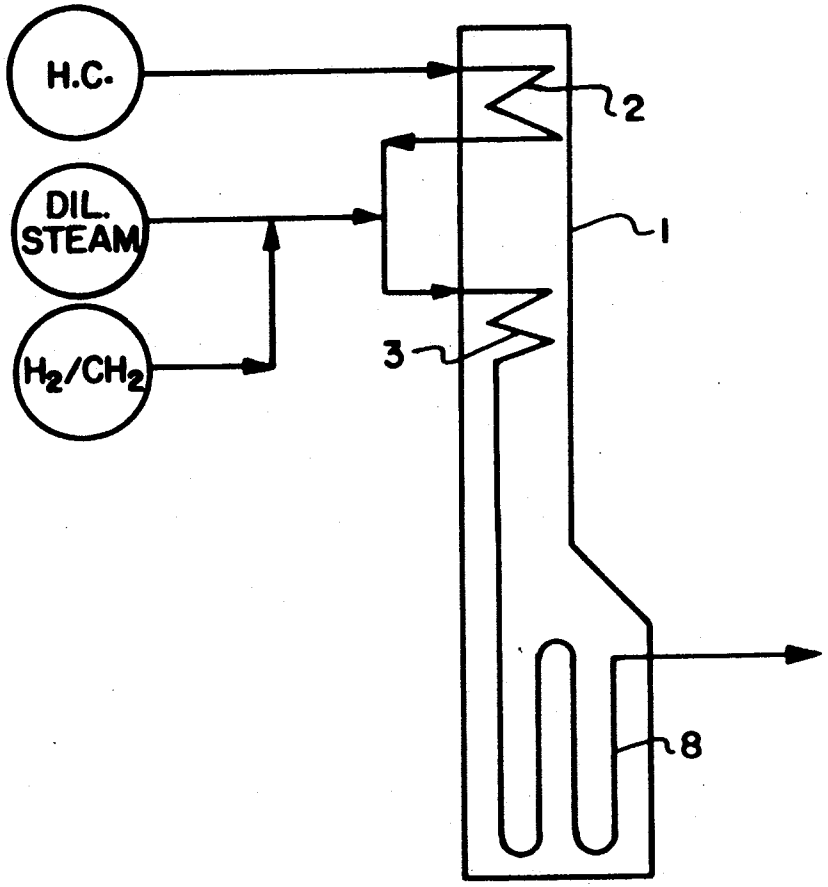
FIG. 3 shows another aspect of the present invention, and depicts a schematic flow diagram in which the critical amount of hydrogen is added to a mixture of the hydrocarbon feedstock and total dilution steam. It illustrates a pyrolysis furnace having a conventional convection section but no dilution steam superheating coil, no mixer, and no flash drum, since these are obviated by the use of the critical amount of hydrogen. For the sake of simplicity, other convection heating coils, a steam drum, and a transfer line exchanger are not shown in FIG. 3.

FIG. 3 depicts, as noted, another aspect of the present invention in which the hydrogen is added to the mixture of hydrocarbon feed and total dilution steam. The convection section shown in this FIG. 3 is of conventional design. However, no dilution steam superheating coil 5, no mixer 4, and no flash drum 6 are required in this scheme because the use of the critical amount of hydrogen eliminates the need for this equipment. Preferably, however, this critical amount is increased somewhat to protect the mix preheat coil 3 from coking. For purposes of simplification, other convection heating coils, steam drum 11, and the transfer line exchanger 9 are not included in FIG. 3.

The amount of hydrogen to be used in this invention is a variable dependent upon the overall economics of the olefins plants, i.e. the cost increase of the external vaporization system vis-a-vis the extra cost of the associated equipment for hydrogen recovery and purification. It has been found that with the use of a hydrogen/hydrocarbon feed ratio of 0.01 to 0.15 wt %, the external vaporization system can be eliminated.

Figure 4:
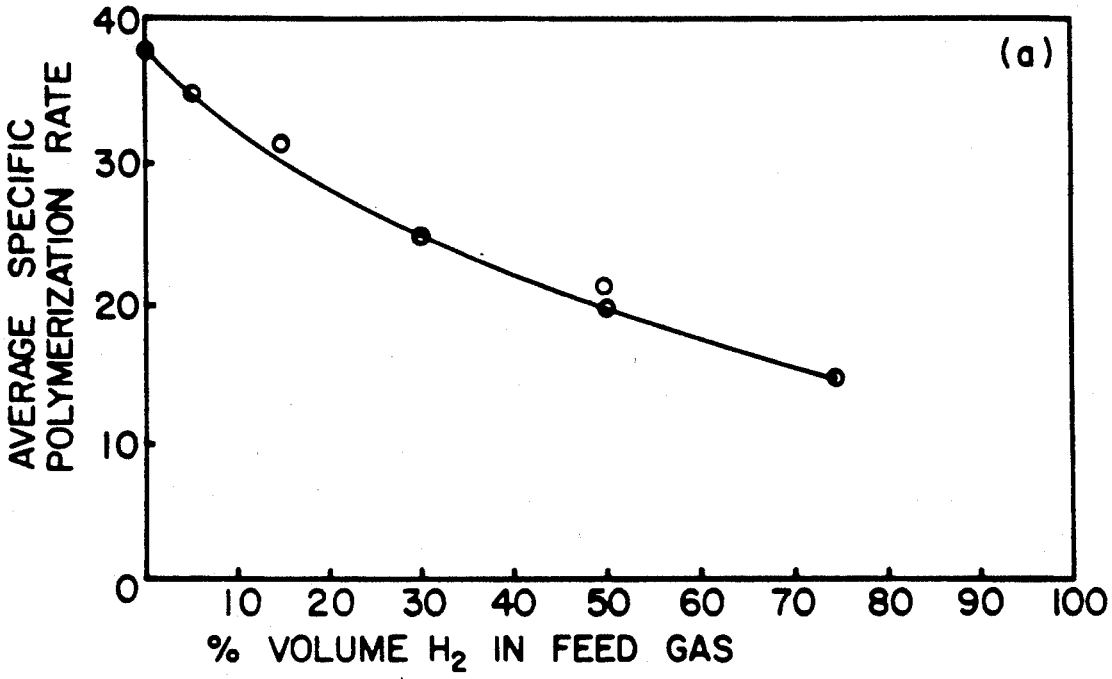
FIGS. 4 and 5 are graphs which illustrate the percent volume hydrogen in the feed gas verses the polymerization rate and the molecular weight.
Figure 5:
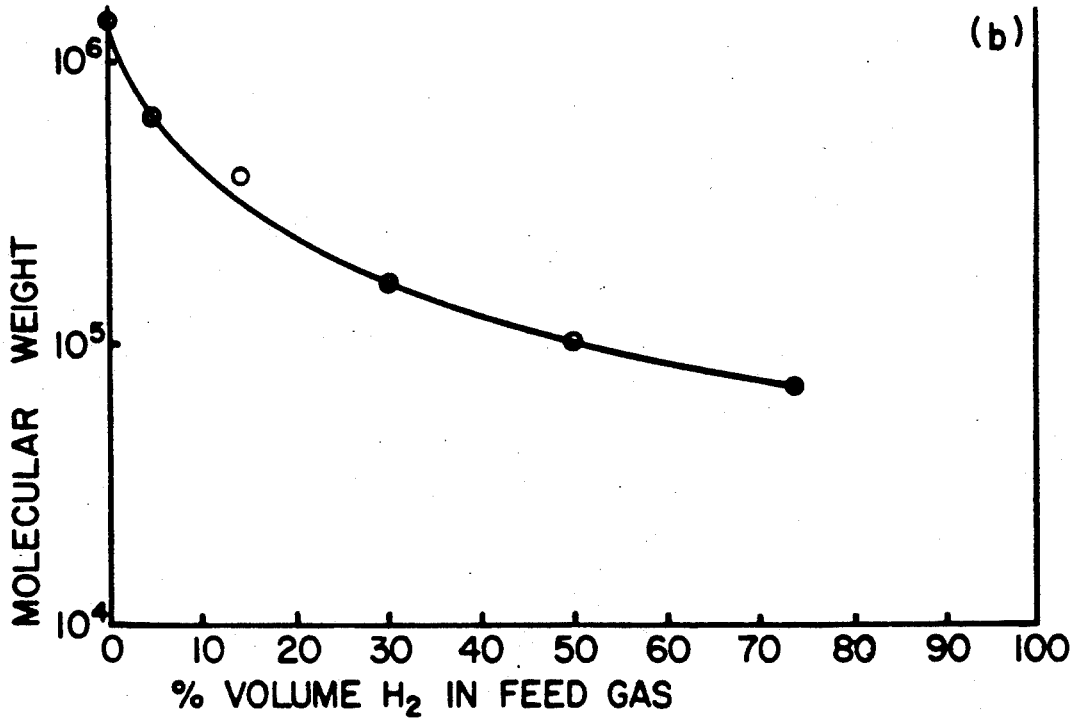

Since the molecular weight of hydrogen is low and the molecular weight of the heavy hydrocarbon feedstock is extremely high, addition of even small quantities of hydrogen leads to a high concentration of hydrogen in that section of the convection section where the vaporization of the hydrocarbon feedstock takes place. Specifically, the addition of 0.05 wt % of hydrogen to a hydrocarbon feed having a molecular weight of about 700 results in 15 vol. % in hydrogen/hydrocarbon mixture. Assuming that FIGS. 4 and 5 are accurate representations with respect to a particular feedstock at room temperature, this would correspond to a reduction in molecular weight of the polymer by a factor of 2 to 3 and to a reduction in the polymerization rate of 25%. At the higher temperatures encountered in the convection section, however, it is anticipated that the inhibition effect exhibited by the hydrogen would be considerably greater. Utilization of a level 0.05 wt % of hydrogen represents about 10% of the hydrogen yield achieved in the furnace effluent during pyrolysis. This would not have any significant impact on the downstream equipment size and utilities consumption.

Without wishing or desiring to be limited to any theoretical explanation for the salutary effects with respect to inhibition of coke formation in the vaporization of heavy hydrocarbons produced by hydrogen addition, it is nonetheless believed that coke deposition in the heating coils of the convection section results from some heavy hydrocarbons being cracked to form olefins at the high temperatures encountered in the convection section during vaporization. These olefins polymerize and eventually form coke. Addition of a small quantity of hydrogen in these coils suppresses the polymerization reactions and thus suppresses the coke deposition. It is believed that hydrogen acts on the polymer chain to terminate the polymer growth reaction. Should a catalyst be present, the hydrogen is believed to act on its active site so as also to terminate the polymerization reaction. Under the high temperature conditions prevailing in pyrolysis furnaces, the olefins are formed in the high temperature region through a free radical mechanism, and the metallic surface of the tubes of the convection heating coils acts as a catalyst to accelerate the polymerization rate. Thus, the polymer eventually gets further dehydrogenated, thereby forming coke.

In order to demonstrate that the hydrogen addition practiced in this invention to inhibit coke formation in the convection section does not have a deleterious effect on hydrogen recycle flow, and also on utilities consumption and investment costs of an ethylene plant, the following example is provided.

EXAMPLE 1

Hydrogen Recycle Flow

In this example, an ethylene plant having a 300,000 million ton per annum production capacity is used as a base plant and point of reference. For such a plant, assuming a hydrogen recycle rate of 0.05 wt. % of the total wt. of the hydrocarbon feedstock, the hydrogen recycle flow would be as follows:

| | |
|---|---|
| Total Hydrocarbon Feedstock | 139483 Kg/Hr |
| $H_2$ Recycle as 95% $H_2$ Purity | 36.4 Kg $Mo^1$/Hr |
| Increase in Compression Power | 0.7% |
| Energy Equivalent, Kcal/KgC−2 | 14 |
| Saving in Dilution Steam Expressed as Kcal/KgC−2 | 7 |
| Net Increase in Energy Consumption in Kcal/KgC−2 | 7 |

What is claimed is:

1. In a process for cracking a crude petroleum feedstock including preheating and vaporizing said feedstock and then cracking said feedstock at a temperature in excess of 560° C. inside the tubes of the radiant section of a pyrolysis heater to produce olefins wherein said feedstock is partially heated to a temperature of 100° C. to 500° C. and then further heated and mixed with steam to produce a mixture of feedstock and a steam at a temperature of 450° C. to 700° C. and wherein said mixture is fed to said cracking step wherein the improvement comprises the further step of mixing from 0.01 to 0.15 wt % hydrogen based on the weight of feedstock with said mixture of feedstock and steam prior to raising the temperature above about 500° C. whereby the formation of coke is reduced when said temperature is raised above about 500° C.

2. In a process according to claim 1 wherein said hydrogen and at least a portion of said steam are heated to 650° C. to 800° C. and then mixed with said partially heated feedstock to produce said mixture.

3. In a process according to claim 1 wherein said hydrogen and steam are mixed with said partially heated feedstock and then the mixture is heated to 450° C. to 700° C.

* * * * *